US006641291B2

(12) United States Patent
Yokoi et al.

(10) Patent No.: US 6,641,291 B2
(45) Date of Patent: Nov. 4, 2003

(54) VEHICLE HEADLAMP

(75) Inventors: Shoichiro Yokoi, Shizuoka (JP); Michihiko Hayakawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/245,915

(22) Filed: Sep. 18, 2002

(65) Prior Publication Data

US 2003/0053319 A1 Mar. 20, 2003

(30) Foreign Application Priority Data

Sep. 19, 2001 (JP) ..... 2001-285349

(51) Int. Cl.[7] ..... F21V 14/08; F21V 17/02

(52) U.S. Cl. ..... 362/512; 362/284; 362/282; 362/324

(58) Field of Search ..... 362/512, 284, 362/324, 351, 282, 539, 322

(56) References Cited

U.S. PATENT DOCUMENTS 6,286,985 B1 9/2001 Ohshio et al.
6,428,195 B1 * 8/2002 Ohshio et al. ..... 362/512
6,488,396 B1 * 12/2002 Hayakawa et al. ..... 362/539
6,565,245 B2 * 5/2003 Yokoi ..... 362/512
2001/0028566 A1 * 10/2001 Ohshio ..... 362/512

FOREIGN PATENT DOCUMENTS

JP 2000-207918 7/2000

* cited by examiner

*Primary Examiner*—Thomas M. Sember
(74) *Attorney, Agent, or Firm*—Fish & Richardson P.C.

(57) ABSTRACT

A vehicle headlamp includes a moveable shade. The front end of the shade body of the movable shade is formed into a substantially semispherical shape. The maximum radius of the pivotal locus of the shade body is smaller than conventional shades that have a front end portion formed into a cylindrical shape. Further, a slot is found in the front end portion that extends along the pivotal face of the movable shade. Therefore, the shade body and the discharge bulb do not interfere with each other even when the movable shade is caused to pivot, and the maximum radius of the pivotal locus of the shade body is further reduced. Thus, the shade body of a fixed shade can be smaller in size so that a greater space can be secured for use in disposing the fixed shade within an allowable range that refrains from unnecessarily shading the light reflected from a reflector.

11 Claims, 5 Drawing Sheets

LOW BEAM

HIGH BEAM

VEHICLE HEADLAMP

BACKGROUND OF THE INVENTION

1. Field of the Invention

The present invention relates to a vehicle headlamp arranged to vary a luminous distribution pattern by movement of a movable shade.

2. Description of the Related Art

A typical vehicle headlamp is designed to emit a beam for use as a low or a high beam by causing a reflector to reflect light forward from a light source. As the required luminous distribution pattern of the low beam is different from that of the high beam, a light source bulb having two light sources or two light source bulbs are normally used for switching between low and high beams by switching the on and off conditions of the two light sources or the two light source bulbs.

Another known vehicle headlamp is arranged to switch beams with the use of a single light source. Particularly, this is often the case with a two-lamp type headlamp that inevitably employs a discharge bulb as a light source bulb.

A conventionally known method of switching beams in the case of such a single light source type is to move a shade as disclosed in Japanese Patent Laid-Open No. 2000-207918. According to this method, a movable shade having a cylindrical shade body and a shade leg portion extended downward from the shade body is arranged so that the movable shade is moved by a shade driving unit between two predetermined positions where a shading quantity of light incident on a reflector from a light source has two different values. The movement of the movable shade is made in longitudinal pivotal motion with a designated part of the shade leg portion as a pivotal center.

In such a vehicle headlamp having a movable shade of the sort mentioned above, direct light moving forward from the light source can be shaded by providing a fixed shade in front of the movable shade. Moreover, the appearance of a lighting device can be improved by making the movable shade and its peripheral structure difficult to see from the outside of the lighting device.

In this case, the fixed shade has to be provided in a position off its pivotal locus so that it does not interfer with the movable shade. However, as the maximum radius of the pivotal locus of the cylindrical shade body is considerably greater, the fixed shade inevitably becomes large-sized. The fixed shade also has to be positioned so as not to unnecessarily cover the light reflected from the reflector. Consequently, a space for use in disposing the fixed shade is greatly restricted and thus the freedom of design is considerably reduced.

The problem mentioned above generally develops not only when switching of low and high beams is carried out by moving the movable shade, but also when the luminous intensity distribution of the lighting device is varied by moving the movable shade.

SUMMARY OF THE INVENTION

The invention provides a vehicle headlamp so arranged as to vary the luminous intensity distribution of a lighting device by moving a movable shade, wherein the design freedom of a fixed shade provided in close vicinity to the front of the movable shade is improved.

A new configuration for the shade body of a movable shade is presented according to the invention.

According to the invention, a vehicle headlamp includes a light source, a reflector for reflecting light forward from the light source, a movable shade capable of shading part of light incident on the reflector from the light source, a shade driving unit for moving the movable shade between two predetermined positions where a shading quantity of light incident on the reflector has two different values, and a fixed shade provided in close vicinity to the front of the movable shade. The movable shade includes a shade body for surrounding the light source over a predetermined range and a shade leg portion extending from the shade body. The movable shade moves with a longitudinal pivotal motion with a predetermined region of the shade leg portion as a pivotal center. Lastly, the front end portion of the shade body is formed into a substantially semispherical shape, a slot extending along the pivotal face of the movable shade being formed in the front end portion thereof.

The 'light source' is not limited to any specific kind but may be, for example, the discharge light emitting portion of a discharge bulb or the filament of an incandescent bulb such as a halogen bulb.

The construction of the 'movable shade' is not limited to any specific embodiment as long as the movable shade is capable of shading part of light incident on the reflector from the light source bulb. The shade body and the shade leg portion may be formed integrally or separately.

The 'two predetermined positions where a shading quantity of light incident on the reflector has two different values,' may be the positions where a luminous distribution pattern for a low beam and a luminous distribution pattern for a high beam are formed by moving the movable shade to the respective predetermined positions, or a position where any other luminous distribution pattern is formed.

The 'shade driving unit' is not limited to any specific driving unit as long as it is so arranged to move the movable shade to one of two predetermined positions. This unit may employ a solenoid or a pulse motor.

The 'longitudinal pivotal motion' is such that the direction of its pivotal axis is not limited but may be any one of the lateral, vertical and oblique directions with the predetermined region of the shade leg portion as a pivotal center.

The phase 'pivotal face of the movable shade' means a plane crossing at right angles with the pivotal axis of the movable shade.

The phase 'along the pivotal face' means along a substantially arcuate curve formed as a line crossing the pivotal face of the movable shade and the front end portion of the shade body.

The vehicle headlamp according to the invention is arranged to vary the luminous intensity distribution of the lighting device by longitudinally pivoting the shade body that surrounds the discharge light emitting portion over a predetermined range. The movable shade has a shade leg portion extending from the shade body with the region near the lower end portion of the shade leg portion as the pivotal center. In addition, the front end portion of the shade body is formed into a substantially semispherical shape and a slot extending along the pivotal face of the movable shade is formed in the front end portion thereof, whereby the following operation/working-effect is achievable.

As the front end portion of the shade body is formed into the substantially semispherical shape, the maximum radius of the pivotal locus of the shade body can be made smaller in comparison with the conventional case where the front end portion thereof is formed into a cylindrical shape. Further, because as the slot is formed in the front end portion of the shade body, the shade body does not interface with the discharge bulb even though the diameter of the front end portion of the shade body is set at a considerably small value. The slot is formed so as to extend along the pivotal face of the movable shade, whereby the shade body is prevented from interfering with the discharge bulb even when the movable shade is caused to pivot. Therefore, the maximum radius of the pivotal locus of the shade body is considerably reducible as compared with the conventional shade body.

Consequently, the fixed shade provided in close vicinity to the front of the movable shade can be formed considerably smaller in size. Thus, a greater space for use in disposing the fixed shade can be secured within an allowable range of refraining from unnecessarily shading the light reflected from the reflector.

In the vehicle headlamp arranged to vary the luminous intensity distribution of the lighting device by moving the movable shade according to the invention, the design freedom of the fixed shade is enhanced.

In the vehicle headlamp according to the invention, the inertial load applied to the shade body when the movable shade is caused to pivot is decreased because the shade body is smaller in size than conventional shades, and thus, it is possible to reduce the load of the shade driving unit.

With the arrangement above, when the movable shade remains in the position where the shading quantity has a relatively large value, the diameter of the shade body is minimized by making the center position of the imaginary semispherical surface formed by the front end portion of the shade body conform to the position of the light source. Consequently, the design freedom of the fixed shade is enhanced further.

With the arrangement above, when the movable shade remains in the position where the shading quantity has a relatively large value, the diameter of the shade body is reduced further by passing the front end portion of the light source bulb through the slot formed in the front end portion of the shade body and extending the front end portion thereof ahead on the front end portion of the shade body. Consequently, the design freedom of the fixed shade is further enhanced.

With the arrangement above, the rigidity of the shade body is increased by forming a step portion in the front end portion of the shade body in such a way as to surround the slot. It is then possible to not only enlarge the opening area of the slot to that extent but also to decrease the thickness of the shade body.

DETAILED DESCRIPTION

An embodiment of the invention will now be described with reference to the drawings.

Figure 1:
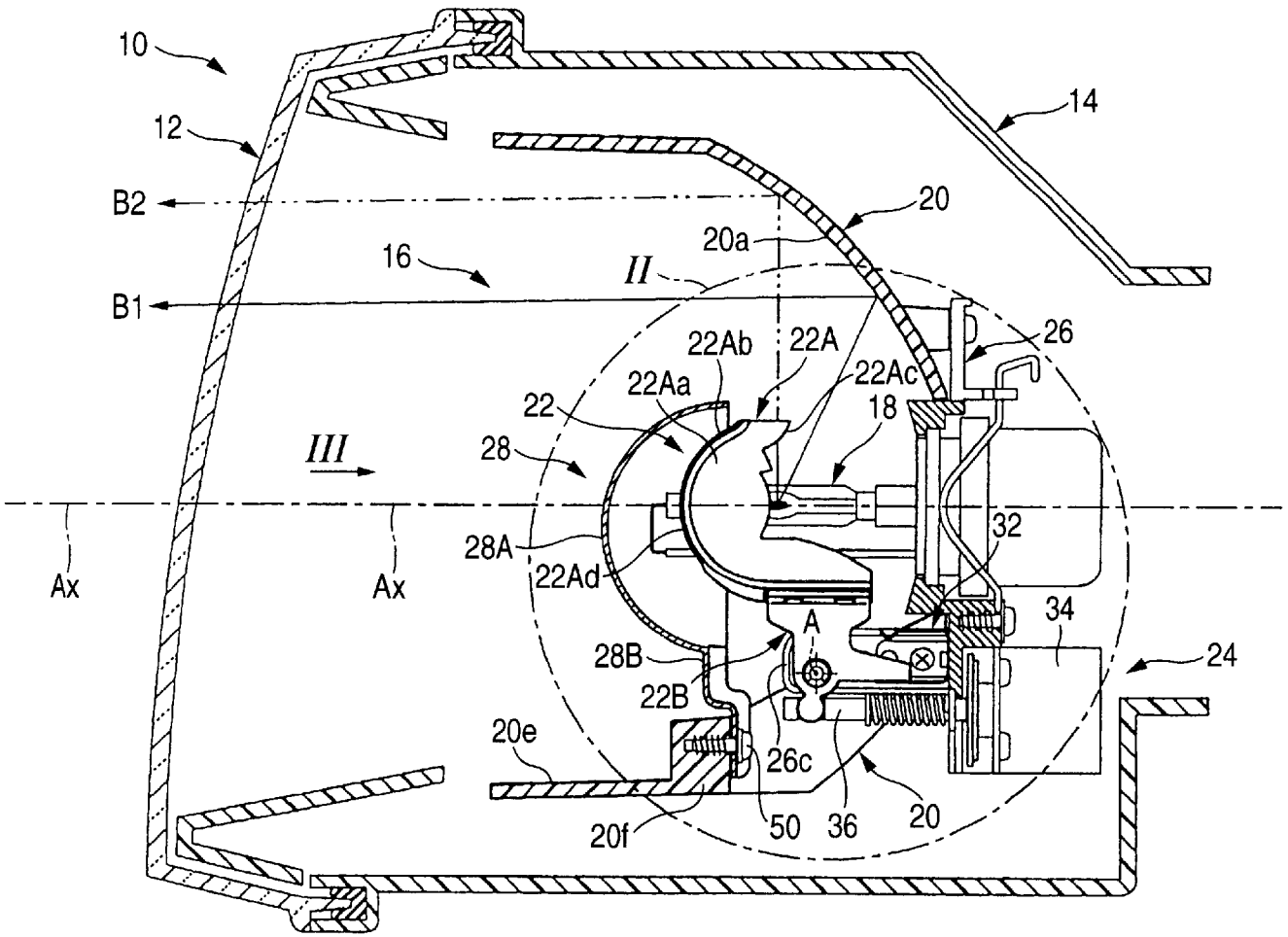
FIG. 1 is a side sectional view of a vehicle headlamp embodying the invention.
Figure 2:
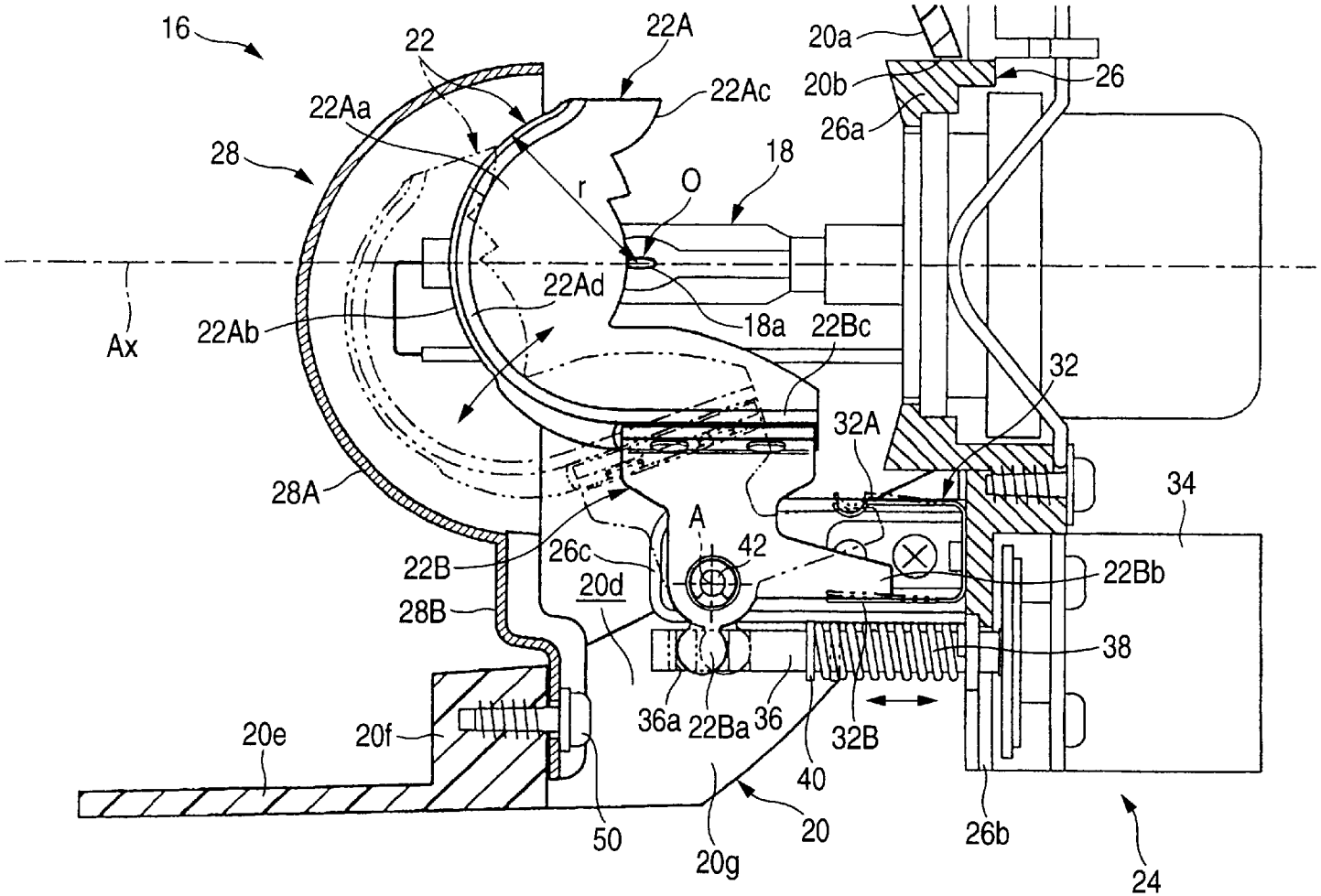
FIG. 2 is a detailed view of a portion II of FIG. 1.
Figure 3:
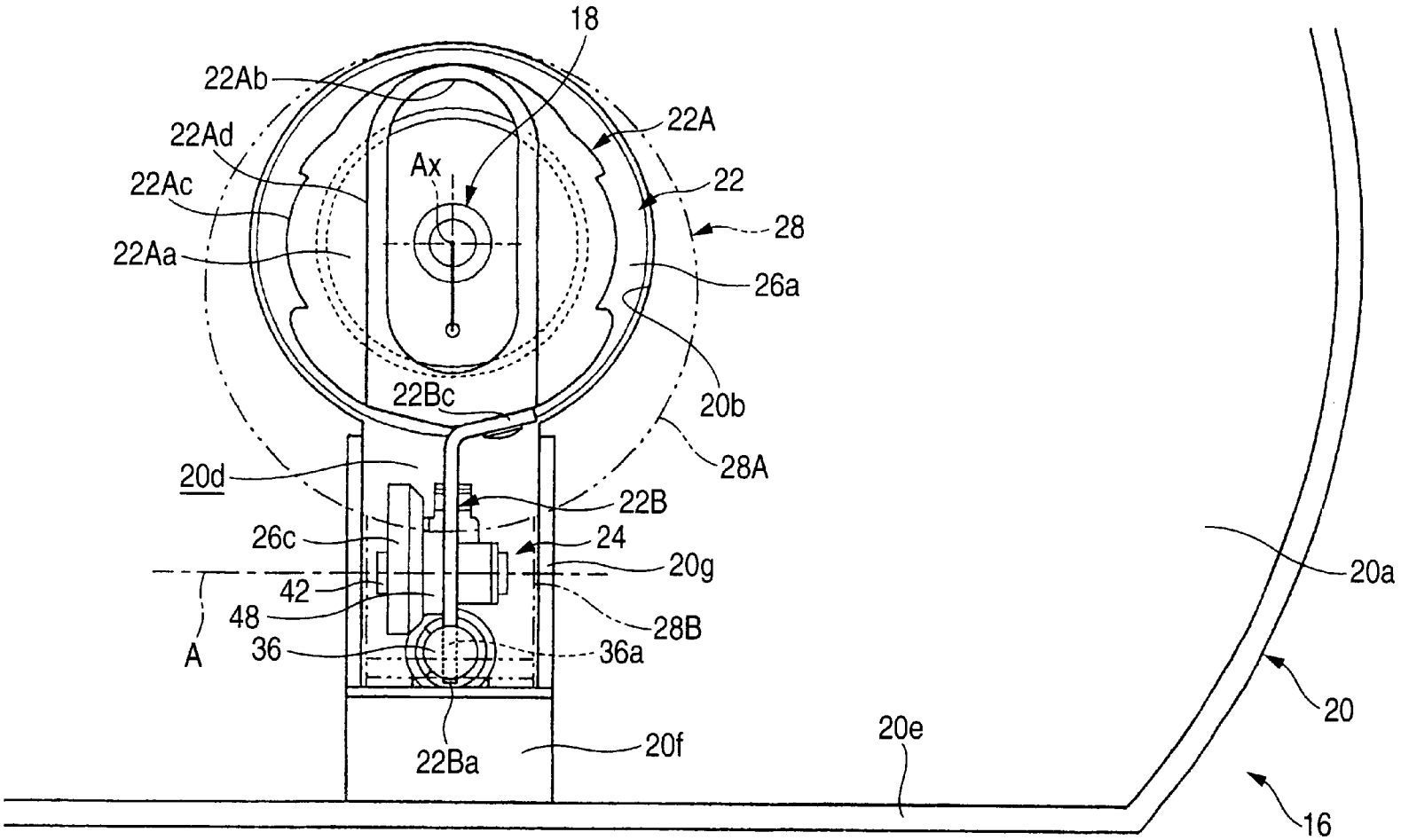
FIG. 3 is a sectional view taken on line III of FIG. 1.
Figure 4:
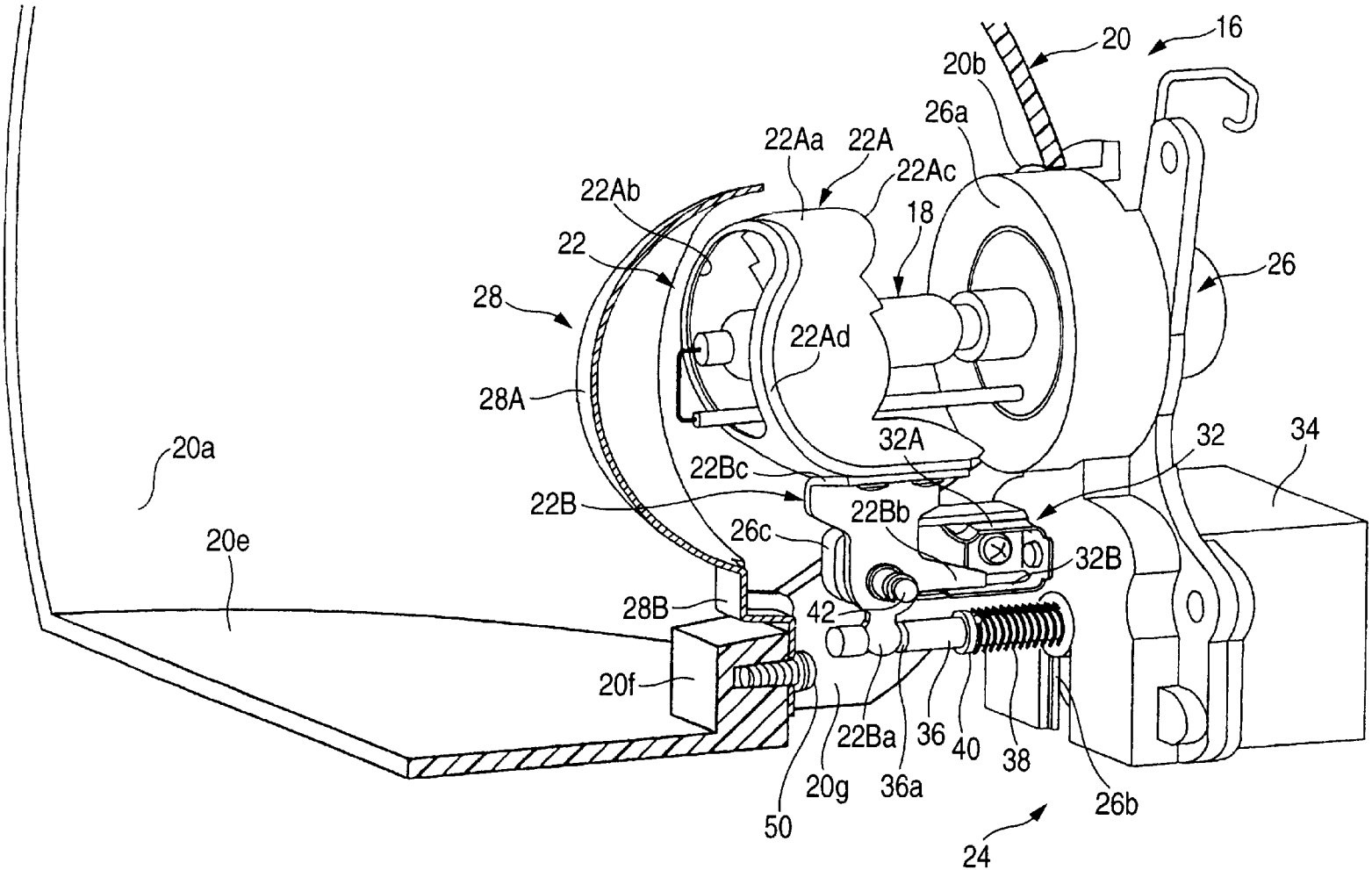
FIG. 4 is a detailed sectional perspective view of the principal part of the vehicle headlamp.

FIG. 1 is a side sectional view of a vehicle headlamp embodying the invention; FIG. 2 is a detailed view of a portion II of FIG. 1; FIG. 3 is a sectional view taken on line III of FIG. 1; and FIG. 4 is, a detailed sectional perspective view of the principal part of the vehicle headlamp.

As shown in these drawings, a vehicle headlamp 10 according to this embodiment of the invention has a reflector unit 16 installed in a lamp chamber formed with a transparent cover 12 and a lamp body 14, the reflector unit being vertically and horizontally tiltable via an aiming mechanism (not shown).

The reflector unit 16 includes a discharge bulb (metal halide bulb) 18, a reflector 20, a movable shade 22, a shade driving unit 24, a bulb supporting base 26 and a fixed shade 28.

The transparent cover 12 is formed in a see-through form and the reflector unit 16 is equipped with a luminous intensity distribution control function. The reflector 20 of the reflector unit 16 has a reflective surface 20*a* for reflecting light in a forward direction from the discharge light emitting portion (light source) 18*a* of the discharge bulb 18, and emits a beam forward with a predetermined luminous distribution pattern using the diffusion or deflection reflective function of the reflective surface 20*a*.

The discharge bulb 18 is fixedly supported by the reflector 20 via a bulb supporting base 26. More specifically, the bulb supporting base 26 is fixed to the reflector 20 with screws in such a condition that it is inserted from behind into the rear top opening 20*b* of the reflector 20. The discharge bulb 18 is fixedly supported with a wire spring by the annular support portion 26*a* of the bulb supporting base 26, whereby the discharge light emitting portion 18*a* is positioned on the optical axis Ax of the reflector 20.

In the lower region of the rear top opening 20*b* in the reflective surface 20*a* of the reflector 20, a rectangular opening 20*d* is formed that communicates with the rear top opening 20*b*. The shade moving mechanism of the shade driving unit 24 is contained in the rectangular opening 20*d*. An undersurface wall 20*e* is formed in the lower end portion of the reflective surface 20*a* of the reflector 20, and a fixed-shade mounting projection 20*f* projects upward from the front end portion of the rectangular opening 20*d* of the undersurface wall 20*e*. A pair of upright wall portions 20*g* are formed respectively on both the right and left side portions of the rectangular opening 20*d* in the reflective surface 20*a* of the reflector 20.

The movable shade 22 includes a shade body 22A that surrounds the discharge light emitting portion 18*a* of the discharge bulb 18 over a predetermined range of the discharge light emitting portion thereof. A shade leg portion 22B extends downward from the lower end portion of the shade body 22A and is pivotably supported by the bulb supporting base 26 around an axis of rotation A extending in the right and left directions in a region near the lower end portion of the shade leg portion 22B.

The shade driving unit 24 causes the movable shade 22 to longitudinally pivot around the axis of rotation A to take a low-beam forming position shown by a solid line in FIG. 2 and a high-beam forming position shown by a chained double-dashed line in FIG. 2. In the low-beam forming position, light incident on the peripheral edge area of the reflective surface 20*a* from the discharge light emitting portion 18*a* of the discharge bulb 18 is shaded, whereby only light necessary for emitting the low beam is incident on the reflective surface 20*a*. In the high-beam forming position, the shading operation is canceled to secure the amount of light necessary for emitting the high beam.

Figure 5:
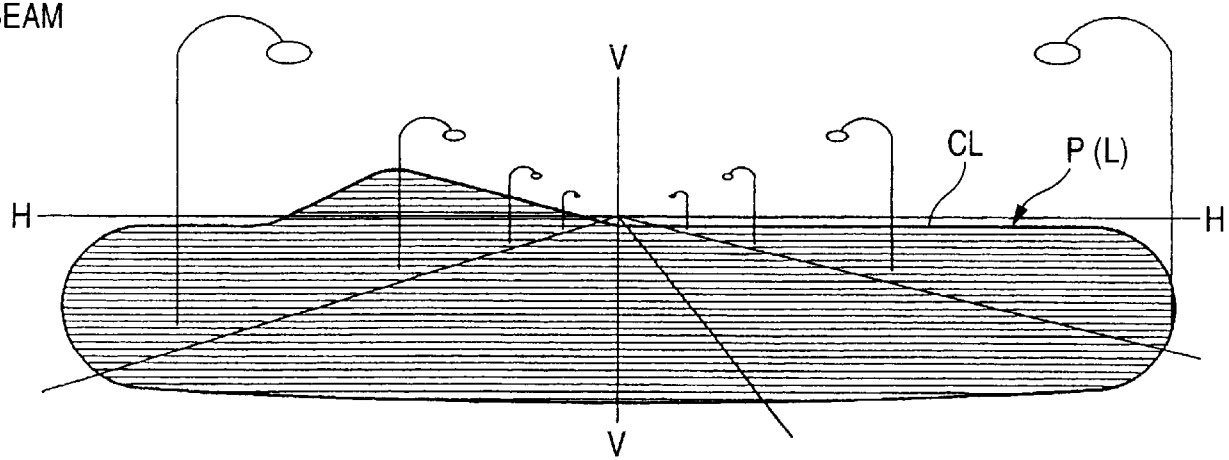
FIGS. 5(*a*) and 5(*b*) are diagrams showing luminous distribution patterns when beams are emitted forward from the vehicle headlamp, wherein FIG. 5(*a*) shows a luminous distribution pattern for a low beam; and wherein FIG. 5(*b*) shows a luminous distribution pattern for a high beam.
Figure 5:
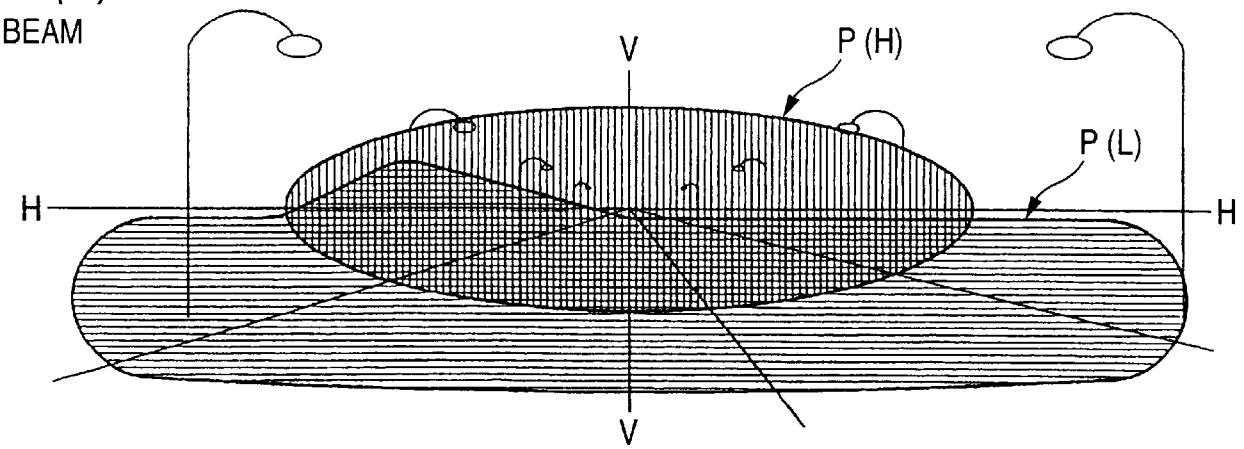

FIGS. 5(*a*) and 5(*b*) illustrate luminous distribution patterns when beams are emitted in a forward direction from the vehicle headlamp 10.

FIG. 5(*a*) shows a low beam luminous distribution pattern P(L) formed by the light reflected from the central area of the reflective surface 20*a* (reflected light B1 shown by a solid line in FIG. 1). The low beam luminous distribution pattern P(L) has a cut-off line (boundary line between light and shade) CL in the upper end portion thereof, whereby no glare is given to the driver of any oncoming car.

FIG. 5(*b*) shows a high beam luminous distribution pattern P(H) that is formed by synthesizing the luminous distribution pattern for the low beam P(L) with an additional luminous distribution pattern formed by the light reflected from the peripheral edge area of the reflective surface 20*a* (reflected light B2 shown by a chain double-dashed line in FIG. 1).

In an implementation, the shade body 22A of the movable shade 22 is formed by press-molding and its shade leg portion 22B is a processed product formed by bending a sheet material. The upper end portion of the shade leg portion 22B is formed by bending into a substantially L-shaped upper end flange portion 22Bc. The lower end portion of the shade body 22A is fixedly riveted onto the upper end flange portion 22Bc.

The front end portion 22Aa of the shade body 22A is formed into a substantially semispherical shape. As shown in FIG. 2, the center position O of the imaginary semispherical surface of a radius r that this front end portion 22Aa forms is set so that the center position O substantially conforms to the position of the discharge light emitting portion 18*a*. A vertically extending slot 22Ab is formed in the front end portion 22Aa. The diameter of the slot 22Ab is set so that the front end portion 22Aa of the discharge bulb 18 passes through the slot 22Ab and extends ahead on the front end portion 22Aa when the movable shade 22 is in a position where the low beam is formed.

A step portion 22Ad is formed in the front end portion 22Aa of the shade body 22A in such a way as to surround the slot 22Ab. However, the step portion 22Ad extends up to the rear end edge 22Ac of the shade body 22A while maintaining the lateral width of the slot 22Ab in the lower end portion of the shade body 22A.

The rear end edge 22Ac of the shade body 22A has a complicated rugged shape in order to obstruct the incidence of light on the peripheral edge area of the reflective surface 20*a* from the discharge light emitting portion 18*a* while the movable shade 22 remains in the position where the low beam is formed.

The shade driving unit 24 includes a solenoid 34 fixed to the bulb supporting base 26 with screws under the optical axis Ax of the reflector 20. A return spring 38 mounted on the plunger (moving iron core) 36 of the solenoid 34 is used to urge the plunger 36 toward a nonexciting position.

The plunger 36 extends forward and it passes through an inverted U-shaped groove 26*b* formed in the lower end portion of the bulb supporting base 26. An E ring 40 is mounted in the intermediate portion of the plunger 36 and abuts the front end portion of the return spring 38 to catch the elastic urging force of the return spring 38. A cutout portion 36*a* that is U-shaped in sectional plan view is formed in the peripheral face of a region near the front end of the plunger 36.

As described above, the movable shade 22 is supported by the bulb supporting base 26 in the region near the lower end portion of the shade leg portion 22B; in particular, supported by a support bracket portion 26*c* projection forward from the bulb supporting base 26 via a bearing material 42. An annular spacer 48 is fitted between the shade leg portion 22B and the support bracket portion 26*c*, to minimize any backlash between the joint portion between the shade leg portion 22B and the bearing material 42.

The movable shade 22 engages the front end portion of the plunger 36 in the lower end portion of the shade leg portion 22B of the movable shade in such a manner that an engaging portion 22Ba formed in the lower end portion of the shade leg portion 22B is inserted into the cutout portion 36*a* of the plunger 36. When the engaging portion 22Ba abuts on the front end face or rear end face of the cutout portion 36*a*, this action causes the reciprocating motion of the plunger 36 to be converted into pivotal motion of the movable shade 22. The front and rear end faces of the engaging portion 22Ba are reduced to a substantially arcuate configuration so that the front and rear end faces thereof are allowed to abut on the front or rear end face of the cutout portion 36*a* smoothly even when the pivotal angle of the movable shade 22 varies.

A displacement regulating member 32 having elastic pieces 32A and 32B extends forward in the form of two vertical steps is attached to a region near the base portion of the support bracket portion 26*c* of the bulb supporting base 26. A projection 22Bb projects backward from the shade leg portion 22B of the movable shade 22, the projection being positioned between the elastic pieces 32A and 32B. The upper edge face of the projection 22Bb obliquely extends downward, whereas the lower edge face thereof extends horizontally. The projection 22Bb abuts on the elastic piece 32A when the movable shade 22 pivots toward the high beam position and subjects the elastic piece 32A to elastic deformation, whereas the projection 22Bb abuts on the elastic piece 32B when the movable shade 22 pivots toward the low beam position and subjects the elastic piece 32B to elastic deformation. Thus, when switching beams the movable shade 22 is properly positioned without producing a large strike sound.

The fixed shade 28 is in close vicinity to the front of the movable shade 22 and the movable shade 22 is covered therewith.

The fixed shade 28 is formed integrally with a semispherical shade body 28A projecting forward and a shade leg portion 28B which projects downward from the lower end portion of the shade body 28A and is U-shaped in cross section, and has an intermediate portion offset in a backward direction. The lower end portion of the shade leg portion 28B of fixed shade 28 is mounted on the rear side of the fixed-shade mounting projection 20*f* with screw 50. The shade leg portion 28B of the fixed shade 28 has substantially the same width as that of the rectangular opening 20*d* of the reflector 20 and is held between the upright wall portions 20*g* by inserting the shade leg portion 28B into the rectangular opening 20*d*.

As shown in FIG. 2, the diameter of the semispherical surface of the shade body 28B is set at a value greater to some extent than the diameter of the front end portion 22Aa of the shade body 22A. The center position of the semispherical surface is positioned slightly lower than the optical axis Ax, whereby a predetermined gap is secured between the front end portion 22Aa of the shade body 22A and the shade body 28A of the fixed shade 28 not only when the movable shade 22 is in the position where the low beam is formed, but also when the movable shade is caused to pivot toward the position where the high beam is formed.

As set forth above in detail, the vehicle headlamp 10 according to this embodiment of the invention is so arranged as to vary the luminous intensity distribution of the lighting device by longitudinally pivoting the shade body 22A that surrounds the discharge light emitting portion 18*a* over the predetermined range. The movable shade 22 has the shade leg portion 22B extending from the shade body 22A with the region near the lower end portion of the shade leg portion 22B as a pivotal center. The front end portion 22Aa of the shade body 22A is formed into the substantially semispherical shape, and the slot 22Ab extending along the pivotal face of the movable shade 22 is formed in the front end portion 22Aa thereof, whereby the following operation/working-effect is achieved.

Since the front end portion 22Aa of the shade body 22A is formed into a substantially semispherical shape, the maximum radius of the pivotal locus of the shade body 22A can be minimized in comparison to the conventional case where the front end portion thereof is formed into a cylindrical shape. In addition, because the slot 22Ab is formed in the front end portion 22Aa of the shade body 22A, the shade body 22A does not interfere with the discharge bulb 18 even though the diameter of the front end portion 22Aa of the shade body 22A is set at a considerably small value. Moreover, the slot 22Ab is formed to extend along the pivotal face of the movable shade 22, so that the shade body 22A does not interfere with the discharge bulb 18 even when the movable shade 22 is caused to pivot. Therefore, the maximum radius of the pivotal locus of the shade body 22A is considerably reduced as compared with the conventional shade body 22A.

Consequently, the fixed shade 28 provided in close vicinity to the front of the movable shade 22 can be considerably smaller in size, so that a greater space for use in disposing the fixed shade 28 can be secured within an allowable range of refraining from unnecessarily shading the light reflected from the reflector 20. Thus, the design freedom of the fixed shade is enhanced.

In the vehicle headlamp 10 according to this embodiment of the invention, the inertial load applied to the shade body 22A is lowered when the movable shade 22 is caused to pivot because the shade body 22A is smaller in size than conventional shade bodies. Thus, the load of the shade driving unit 24 is reduced.

When the movable shade 22 is in the low beam position according to this embodiment of the invention, the center position of the imaginary semispherical surface formed by the front end portion 22Aa of the shade body 22A conforms to the position of the discharge light emitting portion 18*a*, and the diameter of the shade body 22A is minimized, such that the design freedom of the fixed shade 28 is further enhanced.

In addition, according to an embodiment, as the front end portion 22Aa of the discharge bulb 18 is passed through the slot 22Ab formed in the front end portion 22Aa of the shade body 22A and extends ahead on the front end portion 22Aa of the shade body 22A when the movable shade 22 is in the position where the low beam is formed, the diameter of the shade body 22A is reduced further, whereby the design freedom of the fixed shade 28 is enhanced considerably.

Even though the slot 22Ab is formed in the front end portion 22Aa of the shade body 22A of the movable shade 22 so as to project the front end portion of the discharge bulb 18 forward from the slot 22Ab, the direct light emitted forward via the slot 22Ab from the discharge light emitting portion 18*a* is shaded by the fixed shade 28. Thus, the function of the lighting device is never impaired.

According to an embodiment, the step portion 22Ad is formed in the front end portion 22Aa of the shade body 22A in such a way as to surround the slot 22Ab. Thus, the rigidity of the shade body 22A is enhanced, whereby it is possible to not only enlarge the opening area of the slot 22Ab but also attempt to decrease the thickness of the shade body 22A.

According to an embodiment, the shade body 22A is formed by press-molding, so that sufficiently high rigidity can be secured for the movable shade 22A even if its thickness is decreased.

Although a description has been given of the fact that the semispherical shade body 28A of the fixed shade 28 is formed, such a shade body may have any other configuration.

What is claimed is:

1. A vehicle headlamp comprising: a light source, a reflector for reflecting light forward from the light source, a movable shade capable of shading part of the light incident on the reflector from the light source, a shade driving unit for moving the movable shade between two predetermined positions where a shading quantity of light incident on the reflector has two different values, and a fixed shade provided in close vicinity to the front of the movable shade, wherein:

the movable shade includes a shade body for surrounding the light source over a predetermined range and a shade leg portion extending from the shade body;

the movable shade moves with a longitudinal pivotal motion with a predetermined region of the shade leg portion as a pivotal center; and the front end portion of the shade body is formed into a substantially semispherical shape, a slot extending along the pivotal face of the movable shade being formed in the front end portion thereof.

2. The vehicle headlamp as claimed in claim 1, wherein when the movable shade remains in the position where the shading quantity has a relatively large value, the center position of the imaginary semispherical surface formed by the front end portion of the shade body substantially conforms to the position of the light source.

3. The vehicle headlamp as claimed in claim 2, wherein a step portion surrounding the slot is formed in the front end portion of the shade body.

4. The vehicle headlamp as claimed in claim 1, wherein when the movable shade remains in the position where the shading quantity has a relatively large value, the front end portion of a light source bulb extends through the slot on the front end portion of the shade body.

5. The vehicle headlamp as claimed in claim 4, wherein a step portion surrounding the slot is formed in the front end portion of the shade body.

6. The vehicle headlamp as claimed in claim 1, wherein a step portion surrounding the slot is formed in the front end portion of the shade body.

7. The vehicle headlamp as claimed in claim 1, the shade body of the movable shade is formed by press-molding.

8. The vehicle headlamp as claimed in claim 1, the fixed shade includes a semispherical shade body projecting forward and a shade leg portion.

9. A movable shade assembly for a vehicle headlamp comprising:

a shade body for surrounding a light source, the shade body having a shade leg portion extending therefrom; and a shade driving unit for moving the shade between at least two predetermined positions;

wherein the front end portion of the shade body is substantially semispherical and includes a slot that extends along a pivotable face of the movable shade such that the shade body avoids interference with the light source.

10. The assembly as claimed in claim 9 wherein the light source extends through the slot when the movable shade is in a position of increased shading.

11. The assembly as claimed in claim 9 further comprising a step portion surrounding the slot.

* * * * *